US005282714A

United States Patent [19]

Diebolt

[11] Patent Number: 5,282,714

[45] Date of Patent: Feb. 1, 1994

[54] CRANE, PARTICULARLY FOR MATERIAL HANDLING

[76] Inventor: Remy Diebolt, 20 rue du 22 Novembre, 67440 Marmoutier, France

[21] Appl. No.: 804,715

[22] Filed: Dec. 12, 1991

[30] Foreign Application Priority Data

Dec. 14, 1990 [FR] France ..... 90 15888

[51] Int. Cl.[5] ..... B66C 13/00

[52] U.S. Cl. ..... 414/680; 212/261; 212/253; 212/246; 212/245

[58] Field of Search ..... 414/744.1, 744.2, 687, 414/685, 680, 729, 730; 212/261, 182, 253, 246, 245; 37/103; 901/14, 15, 18

[56] References Cited

U.S. PATENT DOCUMENTS

| | | | |
|---|---|---|---|
| 2,966,752 | 1/1961 | Wampach . | |
| 3,032,206 | 5/1962 | McIntyre, Sr. . | |
| 3,270,899 | 9/1966 | Brown et al. . | |
| 3,306,442 | 2/1967 | Devol | 414/730 X |
| 3,533,515 | 10/1970 | Milner, Jr. . | |
| 3,543,944 | 12/1970 | Woodside . | |
| 4,172,684 | 10/1979 | Jenkins | 901/14 X |
| 4,373,953 | 2/1983 | Biller et al. . | |
| 4,861,224 | 8/1989 | Holmes | 212/261 X |

FOREIGN PATENT DOCUMENTS

| | | |
|---|---|---|
| 371788 | 7/1983 | Austria . |
| 1010463 | 12/1957 | Fed. Rep. of Germany . |
| 1269912 | 6/1968 | Fed. Rep. of Germany . |
| 1272558 | 8/1961 | France . |

*Primary Examiner*—Michael S. Huppert
*Assistant Examiner*—Donald W. Underwood
*Attorney, Agent, or Firm*—Young & Thompson

[57] ABSTRACT

A crane for material handling is constituted by a boom (1) and a fixed column (2) for supporting the boom (1). The boom (1) is articulated for vertical swinging movement on and relative to a rotating device (3), mounted for rotation about a vertical axis on or in the column (2) and provided with a torsion-transmitting member (4) passing through the column (2) and coacting at its lower portion with a rotation activator (5) of the boom (1). The boom (1) is provided at its free end with a hook, a grapple or another tool, or with a like rotatable actuator.

2 Claims, 2 Drawing Sheets

2
31
26
32

26
25
28
28
27
24
27

26
30
29

30
29

6
7
3
13
12
15
14
16

CRANE, PARTICULARLY FOR MATERIAL HANDLING

The present invention relates to the field of equipment for material handling in general and the transportation of logs in particular, particularly cranes on road tractors combined with mobile equipment, trailers or cranes mounted in fixed position and has for its object a crane particularly for material handling.

At present, the cranes on log handling tractors or other road vehicles or trailers or even stationarily mounted are generally boom cranes with several folding elements of which the second element at least is foldable by the action of at least one jack disposed below the first element and acting on the lower portion of said second element.

The lower boom element is articulated on the end of a rotatable column and is actuated by at least an external jack bearing by its cylinder on said column, which is mounted on the vehicle chassis or on a fixed chassis by means of a ring or ball bearing turret or by rollers provided with a toothed crown coacting, to drive in rotation the column, either with racks actuated by the jacks, or with a pinion driven by a hydraulic motor.

This manner of mounting of the lower boom element on the column also gives rise to a problem of the size of this latter, as well as a risk of damaging the jack or jacks by shock against the handled products. Moreover, the mounting of the column on the chassis is very complicated and very difficult because it requires precision machining.

Finally, the designs of presently existing cranes do not always permit mounting according to the existing requirements, in particular as to their size and height in the case of mounting on a road vehicle.

The present invention has for its object to overcome these drawbacks.

It thus has for an object a crane, particularly for material handling, essentially constituted by a boom and by a column for reception of the boom mounted on the vehicle chassis or fixed, characterized in that the column is fixed on the chassis, in that the boom is articulated on a rotatable device, guided on or in the column and provided with a transverse member passing through said column and coacting at its lower portion with an actuator for rotating the column, which is provided at its free end with the mounting of a hook, a grapple or another tool, or analogous rotatable actuator.

The invention will be better understood from the following description which relates to a preferred embodiment, given by way of non-limiting example, and explained with reference to the accompanying schematic drawings, in which.

Figure 1:
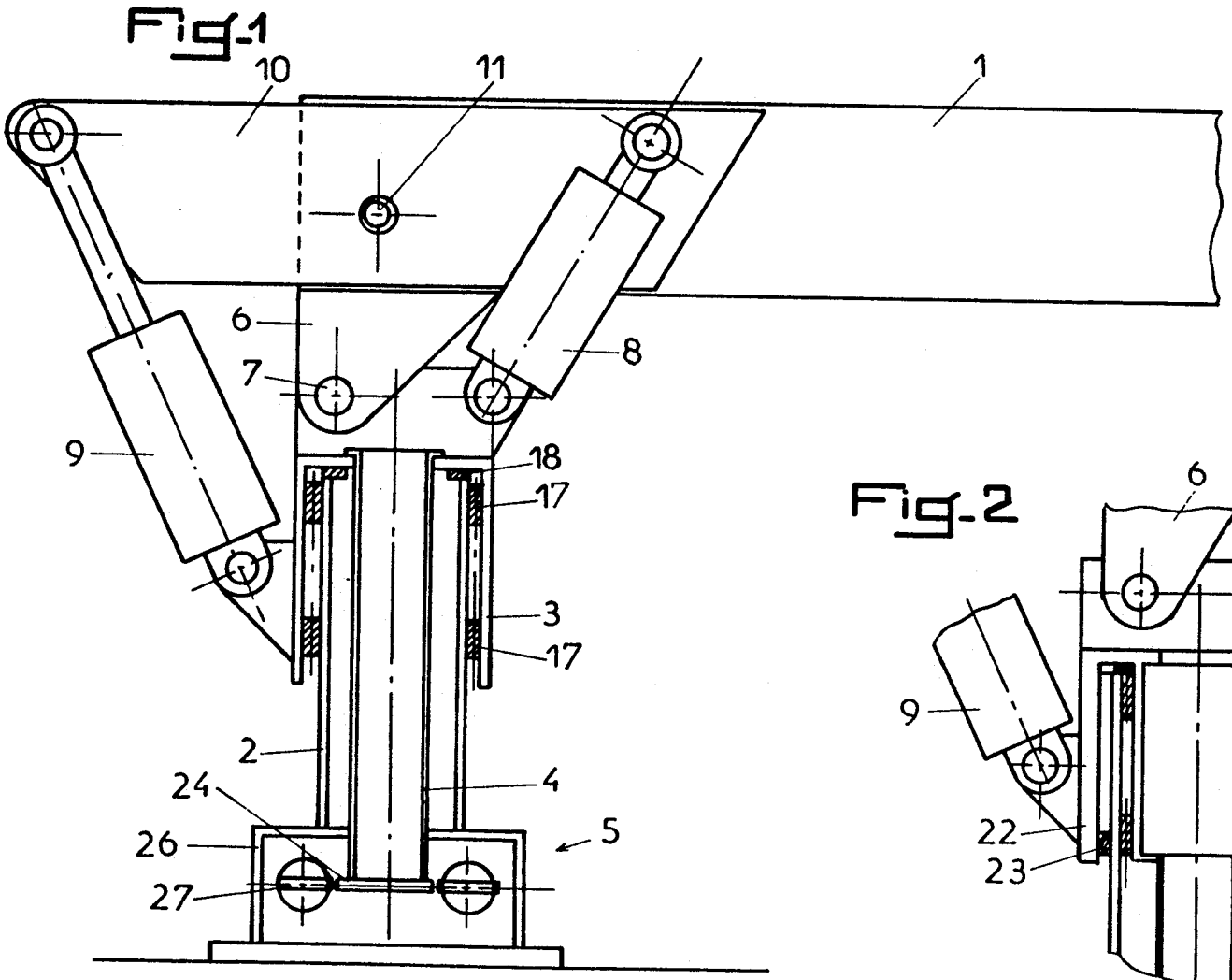
FIG. 1 is a side elevational view in cross section of a crane according to the invention.

According to the invention and as is shown more particularly, by way of example, in FIG. 1 of the accompanying drawings, the crane, particularly for material handling, is essentially constituted by a boom 1 and by a column 2 for reception of the boom mounted on a vehicle chassis or fixed, and is characterized in that the column 2 is fixed on the chassis and in that the boom 1 is articulated on a rotatable device 3 guided on or in the column 2.

This device 3 is provided with a member passing through the column 2 and coacting at its lower portion with an actuator 5 for rotating the boom 1. This latter could for example be provided at its free end with a hook, a grapple or another tool, with a rotation actuator analogous to actuator 5, not shown, permitting directing the handled goods.

The boom 1 is articulated on the rotatable device 3 by means of plates 6 and an axle 7 and is actuated by means of at least one jack 8 mounted articulatedly by its cylinder within the space of the rotatable device 3, substantially on a level with the articulation axle 7, the jack 8 entering the boom 1 and being articulated to this latter so as to obtain a substantially constant lever arm. Such an embodiment permits minimum size adjacent the articulation and the obtention of good protection of the jack 8 against the shocks that might arise from the handled items.

Moreover, the provision of a lever arm that remains constant during all the movement of the boom 1 permits better utilization of the jack 8 and thus better adaptation of its force, such that its size can be reduced.

According to a modified form of the invention, the actuator boom 1 could also be in the form of two jacks, namely a pushing jack 8 and a pulling jack 9 connected by its rod to a rearward prolongation of the boom 1 and mounted articulatedly by its cylinder on the rotating device 3. Thus, the force of the jacks 8 and 9 could be as little as possible and it will be possible to use jacks of the smallest size.

It is also possible, according to another modified embodiment of the invention, to articulate the forks of the jacks 8 and 9 in a slider 10 mounted in the boom 1 and adapted to be blocked in service position (shown in FIG. 1) and in rest position by means of an automatic bolt 11, known per se. Such an embodiment permits optimum use of the jacks 8 and 9 in their service position shown in FIG. 1 and the obtention of minimum size of the crane in its non-use position. In this latter case, the slider 10 is first unlocked by retraction of the bolt 11, then is displaced within the boom 1, by actuation of the jacks 8 and 9.

Figures 3, 4, 5, 6, 7:
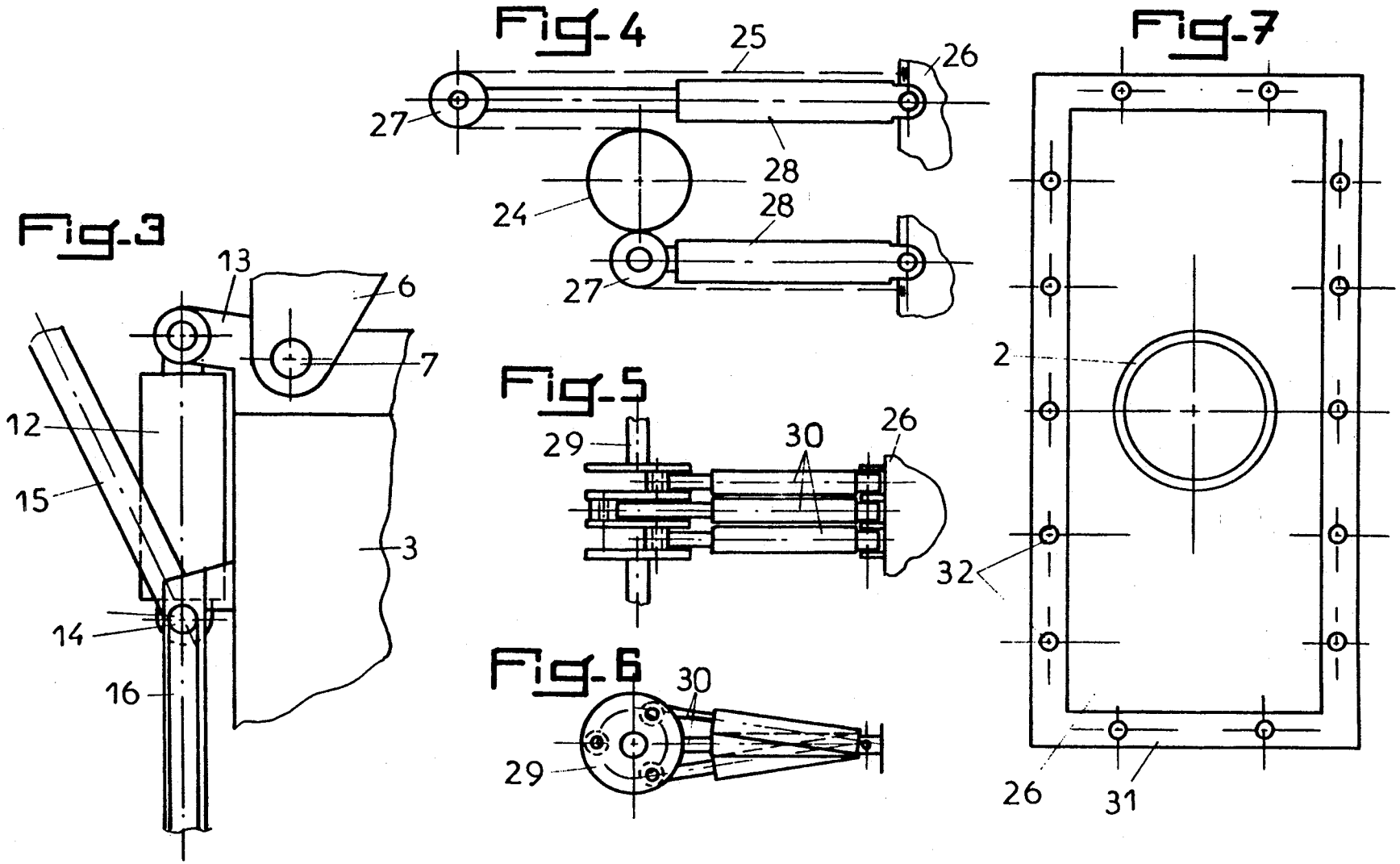
FIG. 3 is a partial side elevational view of a modified embodiment of the actuator for the lower boom element.
FIG. 4 is a plan view of the actuator for rotating the boom.
FIGS. 5 and 6 are views respectively in elevation and in plan of a modified embodiment of the actuator of FIG. 4.
FIG. 7 is a plan view of the socket for reception and securement of the column on the chassis.

According to another characteristic of the invention, shown in FIG. 3, the actuation of the rear end of the boom 1 could also be effected by a pressure jack 12 connected by its piston rod to a member 13 of the rotatable device 3 and by its cylinder, by means of an axle 14, to the end of a fork 15 or a pair of small rods connected by its other end to said rear end of the boom 1, the connecting axle of the fork or the small rods to the jack 12 coacting with vertical guide 16 fixed to the device 3. Thus, the actuation of the boom 1 could be effected by means of two pressure jacks, the rear jack 12 bearing with its piston rod on the member 13 and sliding along the device while pulling on the fork or the small rods 15, such that the force of the jacks necessary for a given leverage could be substantially reduced.

The rotation device 3 (FIG. 1) could be in the form of a sleeve mounted on the end of the column 2, guided on this latter by means of bearings 17 that could be smooth, ball bearings, roller bearings, or needle bearings, and bearing on said column 2 by means of an abutment 18 with needle bearings or roller bearings, this sleeve being provided at its upper portion with the articulation member or members of the boom 1 and with the actuating jack for this latter.

Figure 2:
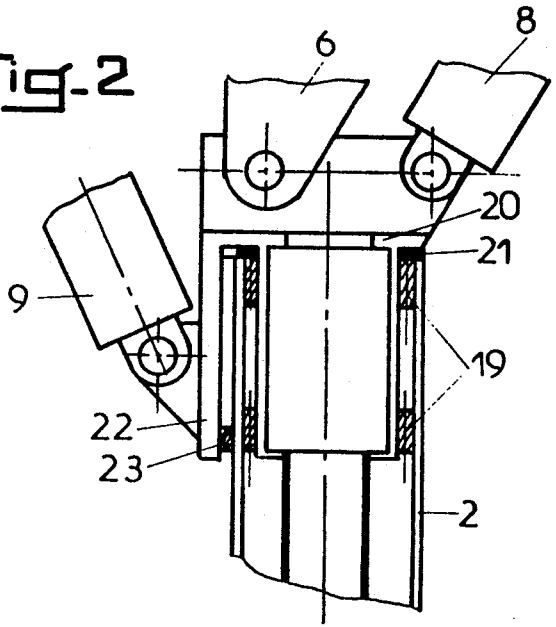
FIG. 2 is a view partially in side elevation of a modified embodiment of the mounting of the rotatable device on the column.

According to a modified embodiment of the invention, the device 3 could also be in the form of a sleeve inserted in the column 2, guided by means of bearings 19 and provided at its upper portion with a bearing plate 20 coacting with an abutment 21 mounted on the end of the column 2, this plate 20 bearing the articulation member or members of the boom 1 and of its actuating jack and being adapted to be provided with a vertical return 22 for reception of a pulling jack, this return 22 bearing on the column by means of a roller 23 or the like (FIG. 2) or being propped by oblique gussets bearing on the plate 20.

These embodiments of the device 3 permit limiting the machining necessary for the column 2 to a very small height and thus reducing correspondingly the cost of the crane assembly.

The rotation actuator 5 of the boom 1 could preferably be constituted, as shown in FIGS. 1 and 4 of the accompanying drawings, by a toothed crown for a chain or by a grooved crown for cable 24, fixed to the lower end of the member 4 passing through the column 2 and secured to the device 3 and coacting with a chain or cable 25, whose two ends are secured to a wall of a casing 26 that receives the actuator 5, said chain or cable 25 being guided moreover on two chain pinions or grooved pulleys 27 rotatably mounted on the end of the piston rods of the two jacks 22 that are parallel or opposed, the axles of connection of the pinions or wheels 27 to said piston rods being guided in corresponding parallel grooves (not shown) provided in the casing 26. Thus, by actuating the jacks 28, it is possible to effect rotation of the boom of the crane in one or the other direction.

The choice of diameter of the crown 24 and the power of the jacks can be a function of the desired torque and/or a function of the useful angle of rotation necessary for good operation of the crane.

FIGS. 5 and 6 show a modified embodiment of the invention, in which the rotation actuator 5 is connected to the lower end of the member 4 entering the casing 26 and is constituted by crankshaft 29, whose cranks are disposed at regular intervals, are preferably at least three in number and are each actuated by a jack 30, the jacks 30 being controlled by means of programmable automation or by a slide valve distributor. Thus, it is possible, by cyclic control of the movement of the piston rods of the jacks 30, to effect a complete and continuous rotation of the member 4. The control device of the jacks is not described in detail and embodies technology known per se.

The member 4 connecting the device 3 to the actuator 5 is preferably in the form of a hollow tube opening at the upper end of the device 3 or in an open chamber at the upper end of said device 3 and coacting at its lower portion with a crown 24 that is centrally recessed. Such a member 4 permits the passage of tubing for feeding the various jacks by flexible means or a rotatable oil distributor and thus avoids the risk of damage to these latter during material handling.

When using, at the free end of the boom 1, a rotation actuator analogous to actuator 5, this latter can be dimensioned differently from actuator 5, namely weaker, as a function of the load to be pivoted or turned.

The column 2 is fixed at its lower part on casing 26 of actuator 5, this casing being provided in its lower portion with a peripheral flange 31 provided with holes 32 for passage of bolts or pins for securing on the chassis of the carrying vehicle. These holes 32 are disposed on the flange 31 as needed for mounting.

Thanks to the invention, it is possible to provide a crane, particularly for material handling, of simple construction, permitting eliminating weak regions existing at present in the known cranes and better protecting the various jacks, as well as their feed lines.

Moreover, the invention permits, by equally dimensioning the jacks, to provide cranes of greater power or else, for a given power, reduce considerably the cost of such a crane.

Of course, the invention is not limited to the embodiment described and shown in the accompanying drawings. Modifications remain possible, particularly as to the construction of the various elements or by substitution of technical equivalents, without thereby departing from the scope of protection of the invention.

I claim:

1. A crane for material handling, comprising a boom (1) and a fixed vertical column (2) supporting the boom (1), a rotatable device (3) in the form of a sleeve supported for rotation about a vertical axis by the upper end of the column, the boom (1) being articulated for vertical swinging movement on and relative to said device (3) about a horizontal axle (7), an elongated torsion-transmitting member (4) passing vertically within and rotatable relative to the column and secured at its upper end to said device (3) to rotate said device (3), and a rotation actuator (5) coacting with the lower end of said torsion-transmitting member (4) to rotate the torsion-transmitting member (4) to rotate said device (3) on and relative to the column thereby to rotate the boom (1) about said vertical axis, wherein the actuation of the boom (1) is effected by means of two jacks, namely a pushing jack (8) connected by its rod to a portion of the boom (1) forward of said axle (7) and articulatedly mounted by its cylinder on the rotatable device (3), and a pulling jack (9) connected by its rod to a rearward prolongation of the boom (1) and articulatedly mounted by its cylinder on the rotatable device, and wherein the rods of the jacks (8) and (9) are articulated to a slider (10) mounted in the boom (1) said slider comprising said portion of the boom formed of the axle and said prolongation of the boom and being adapted to be locked in service position and in rest position by means of an automatic bolt (11).

2. A crane for material handling, comprising a boom (1) and a fixed vertical column (2) having an outside wall and a top end surface supporting the boom (1), a rotatable device (3) in the form of a sleeve supported for rotation about a vertical axis by the upper end of the column, the boom (1) being articulated for vertical swinging movement on and relative to said device (3), an elongated torsion-transmitting member (4) passing vertically within and rotatable relative to the column and secured at its upper end to said device (3) to rotate said device (3), and a rotation actuator (5) coacting with the lower end of said torsion-transmitting member (4) to rotate the torsion-transmitting member (4) to rotate said device (3) on and relative to the column thereby to rotate the boom (1) about said vertical axis, wherein the rotatable device (3) is in the form of a sleeve mounted on the end of the column (2), guided on this latter by means of first bearings (17) mounted between the sleeve and the outside wall of the column (2) and bearing on said column (2) by means of an abutment (18) with second bearings mounted between the sleeve and the top end surface of the column.

* * * * *